United States Patent [19]

Parr

[11] Patent Number: 4,725,051

[45] Date of Patent: Feb. 16, 1988

[54] CUTTING DEVICE IN FOLDING APPARATUS OF A ROTARY PRINTING MACHINE

[75] Inventor: Helmut Parr, Wiesloch, Fed. Rep. of Germany

[73] Assignee: Heidelberger Druckmaschinen AG, Heidelberg, Fed. Rep. of Germany

[21] Appl. No.: 902,164

[22] Filed: Aug. 29, 1986

[30] Foreign Application Priority Data

Aug. 31, 1985 [DE] Fed. Rep. of Germany ... 8524991[U]

[51] Int. Cl.[4] ..... B41F 13/56

[52] U.S. Cl. ..... 270/21.1; 493/360

[58] Field of Search ..... 270/21.1, 5–9, 270/13, 41–42, 47; 493/360, 370, 405, 416, 424, 428, 429, 435, 442

[56] References Cited

U.S. PATENT DOCUMENTS

| | | | |
|---|---|---|---|
| 1,188,088 | 5/1916 | Goss et al. | 270/47 |
| 1,193,450 | 8/1916 | Barber | 270/47 |
| 1,499,106 | 6/1924 | Halliwell | 493/360 |
| 3,927,875 | 12/1975 | Winnemoller et al. | 493/441 |
| 4,564,183 | 1/1986 | Muller | 270/21.1 |

FOREIGN PATENT DOCUMENTS

| | | | |
|---|---|---|---|
| 1132935 | 7/1962 | Fed. Rep. of Germany | 270/47 |

*Primary Examiner*—E. H. Eickholt

*Attorney, Agent, or Firm*—Herbert L. Lerner; Laurence A. Greenberg

[57] ABSTRACT

Cutting device in folding apparatus of a rotary printing machine for forming a second longitudinal fold in foldable items, the folding apparatus having a folding blade disposed parallel to a travel direction of the foldable items and disposed in the middle of the items and between two folding rollers located below the folding blade, and a paddle wheel disposed downstream of the folding blade in the travel direction for receiving and depositing the folded items on a delivery belt, the cutting device includes means defining cutting grooves formed in an outer cylindrical surface of one of the folding rollers, a cutting roller associated with and disposed adjacent to the one folding roller and carrying cutting knives adjustable in position with respect to the cutting grooves, both of the folding rollers being formed on the outer cylindrical surfaces thereof with recesses wherein respective conveyor belts are received, the conveyor belts having respective strands superimposed on one another, the superimposed strands guiding the conveyor belts around the cutting roller and being disposed so as to feed the folded items to the paddle wheel.

5 Claims, 2 Drawing Figures

CUTTING DEVICE IN FOLDING APPARATUS OF A ROTARY PRINTING MACHINE

Figure 1:
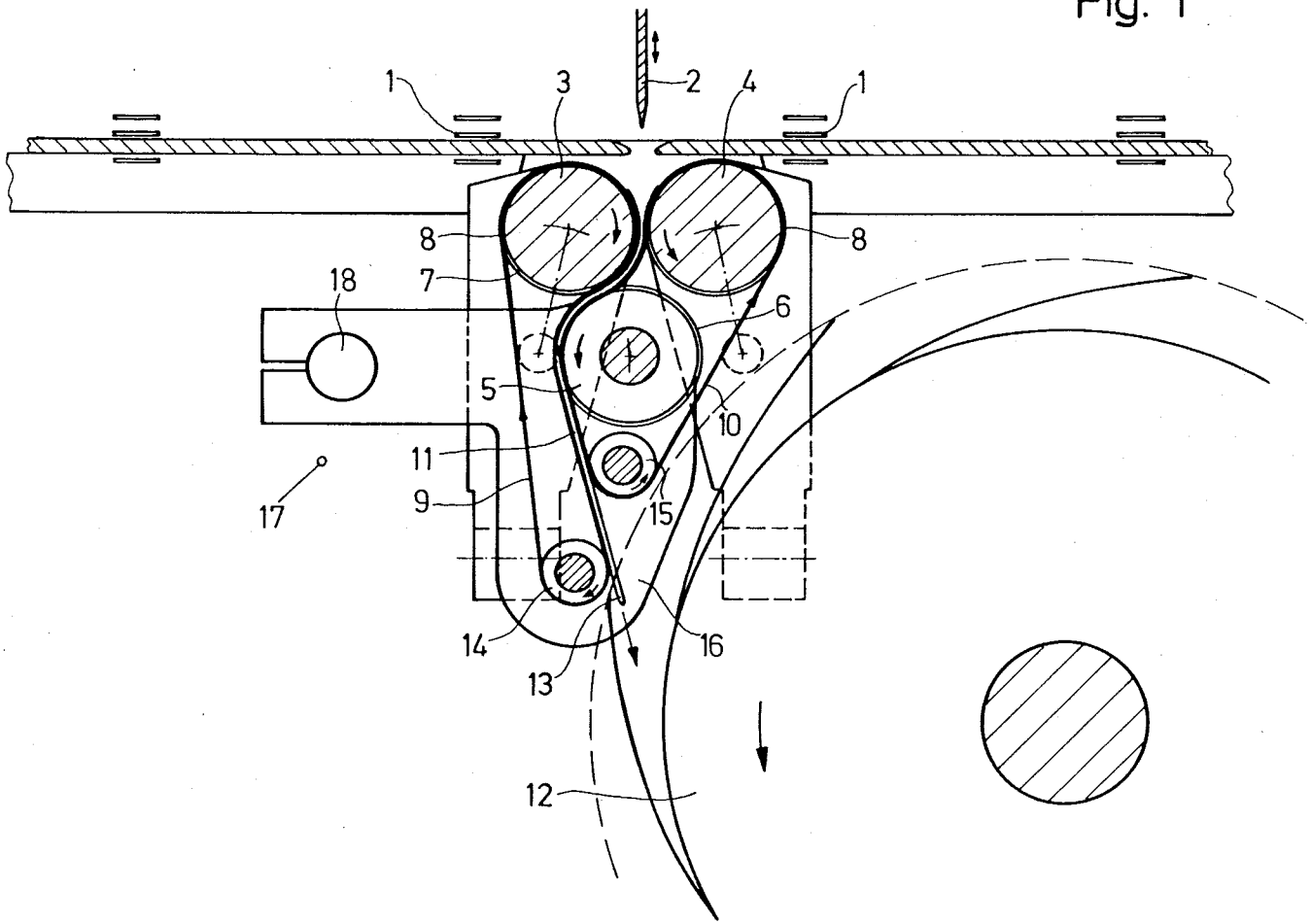

The invention relates to a cutting device in folding apparatus of rotary printing machines and, more particularly, in folding apparatus for forming a second longitudinal fold in foldable items which includes a folding blade disposed parallel to a travel direction of the foldable items and disposed in the middle of the items and between two folding rollers located below the folding blade, and a paddle wheel disposed downstream of the folding blade in the travel direction for receiving and depositing the folded items on a delivery belt.

German Published Non-Prosecuted Application (DE-OS) No. 30 22 772 discloses a cutting device for folded products arranged after or downstream of a rotary printing machine and feeding items to be cut to special cutting stations via conveying devices. Such an extensive cutting device is not only very costly to purchase and operate, it also has a great disadvantage in that considerable installation space is required which often is unavailable in direct vicinity of the rotary printing machine.

Another heretofore known cutting device according to German Pat. No. 25 14 837 is likewise arranged after a printing machine and, in fact, in a conveyor belt transporting the previously folded items. The embodiment of the cutting device disclosed in the German patent is of simpler construction and requires less space, yet has a great disadvantage in that the items being fed by the conveyor belt are not accurately aligned. If the folded items are deposited beforehand on the conveyor belt, for example, by a paddle wheel, the lateral position thereof is not very precise or accurate even if additional aligning means are employed. A consequence thereof is that the subsequent trimming of two edges of the items cannot be performed in register with great accuracy or precision.

Beginning with this state of the art, it is an object of the invention to provide a cutting device of the foregoing general type which cuts items, folded with a second longitudinal fold in a rotary printing machine, true to size on both sides of the back of the fold without having to add expensive cutting devices after or downstream of the folding apparatus.

With the foregoing and other objects in view, theres is provided, in accordance with the invention, a cutting device in folding apparatus of a rotary printing machine for forming a second longitudinal fold in foldable items, the folding apparatus having a folding blade disposed parallel to a travel direction of the foldable items and disposed in the middle of the items and between two folding rollers located below the folding blade, and a paddle wheel disposed downstream of the folding blade in the travel direction for receiving and depositing the folded items on a delivery belt, the cutting device including means defining cutting grooves formed in an outer cylindrical surface of one of the folding rollers, a cutting roller associated with and disposed adjacent to the one folding roller and carrying cutting knives adjustable in position with respect to the cutting grooves, both of the folding rollers being formed on the outer cylindrical surfaces thereof with recesses wherein respective conveyor belts are received, the conveyor belts having respective strands superimposed on one another, the superimposed strands guiding the conveyor belts around the cutting roller and being disposed so as to feed the folded items to the paddle wheel.

With this construction of the invention, a conventional or normal device for forming a second longitudinal fold can be used without extensive modifications. It is necessary only to replace one folding roller and install an additional cutting roller with the conveyor belts in order to be able to deliver fully cut true-to-size folded products at full printing-machine speed. Furthermore, with the aforedescribed embodiment of the invention, the operation of the two folding rollers is not adversely affected by the cutting process, and the product to be cut is accurately or precisely guided without any possibility of an occurrence of cutting differences.

In accordance with another feature of the invention there are provided, two belt diverting rollers located downstream from the cutting roller in the travel direction of the foldable items.

In accordance with another aspect of the invention, there is provided, a cutting device in folding apparatus of a rotary printing machine for forming a second longitudinal fold in foldable items, the folding apparatus having a folding blade disposed parallel to a travel direction of the foldable items and disposed in the middle of the items and between two folding rollers located below the folding blade, and a paddle wheel disposed downstream of the folding blade in the travel direction for receiving and depositing the folded items on a delivery belt, the cutting device including means defining cutting grooves formed in an outer cylindrical surface of one of the folding rollers, a cutting roller associated with and disposed adjacent to the one folding roller and carrying cutting knives adjustable in position with respect to the cutting grooves, and two belt diverting rollers located downstream from the cutting roller in the travel direction of the foldable items, the cutting roller and the belt diverting rollers being mounted at both sides thereof in bearing plates, the bearing plates being mounted so as to be pivotable about trunnions which are mounted in side frames of the cutting device.

In accordance with an added feature of the invention, the cutting knives are mounted on the cutting roller, and the means defining the cutting grooves are disposed on the one folding roller so as to be axially displaceable and adjustable.

In accordance with a concomitant feature of the invention, the one folding roller is formed with a plurality of the cutting grooves so as to correspond to formats of the foldable items being processed.

Other features which are considered as characteristic for the invention are set forth in the appended claims.

Although the invention is illustrated and described herein as embodied in cutting device in folding apparatus of a rotary printing machine, it is nevertheless not intended to be limited to the details shown, since various modifications and structural changes may be made therein without departing from the spirit of the invention and within the scope and range of equivalents of the claims.

Figure 2:
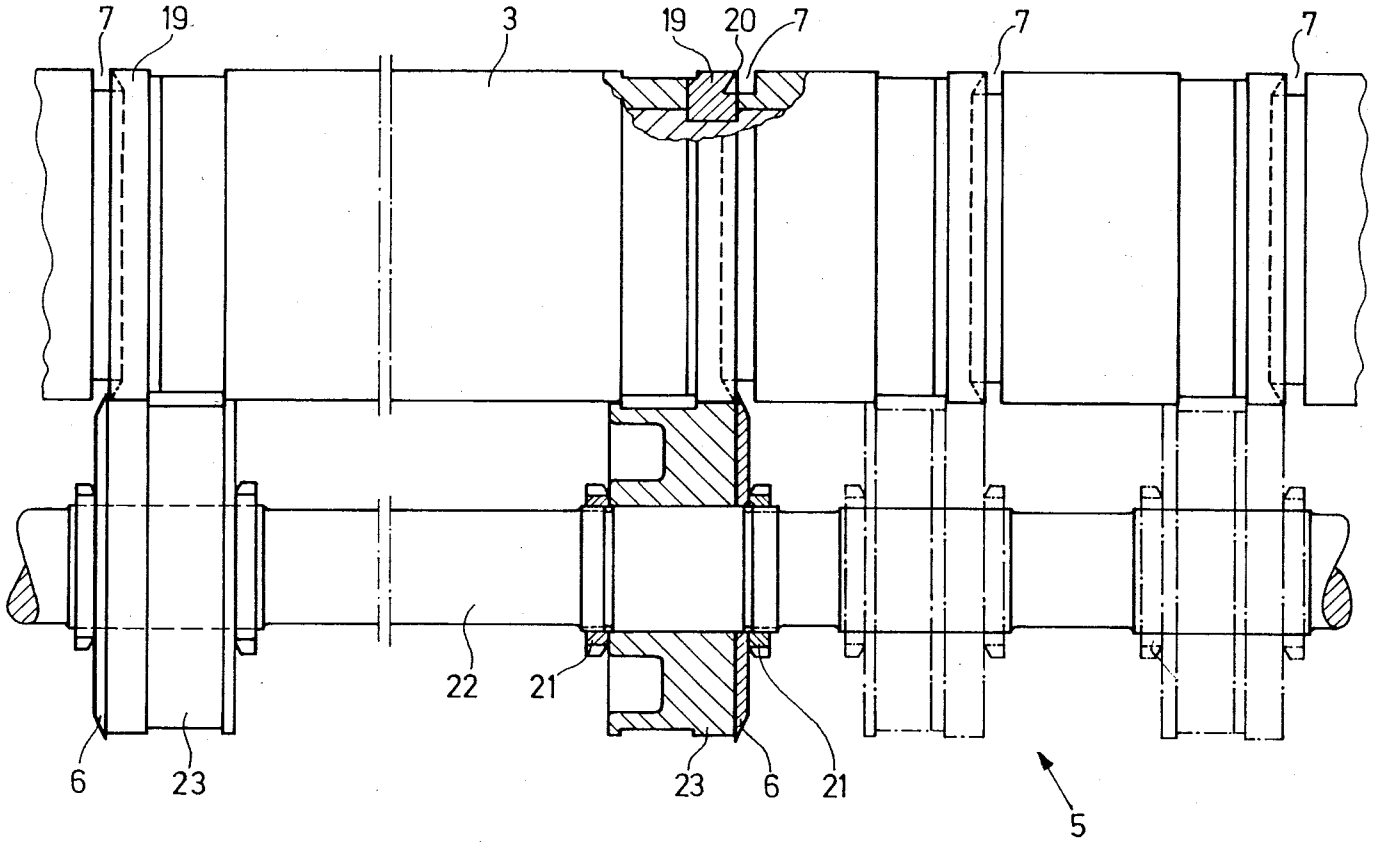

The construction and method of operation of the invention, however, together with additional objects and advantages thereof will be best understood from the following description of specific embodiments when read in connection with the accompanying drawing, in which:

FIG. 1 is a diagrammatic front elevational view, partly in section, of apparatus for forming a second longitudinal fold i.e. a third fold, in a sheet being processed in a rotary printing machine; and FIG. 2 is an enlarged fragmentary side elevational view of FIG. 1, partly broken away and in section, showing a cutting device of the second longitudinal folding apparatus.

Referring now to the drawing and first, particularly, to FIG. 1 thereof, there is shown a device for forming a second longitudinal fold, the device being located in a conventional manner after i.e. downstream from, in travel direction of items being processed, from a folding apparatus of rotary printing machines. Items to be folded in this device are transported by a conveyor belt line 1. The direction of movement of the items once longitudinally folded and cross-folded extends in FIG. 1 perpendicularly out of the plane of the drawing. In a given position, these items are halted by non-illustrated stops and are shoved by a folding blade 2 perpendicularly downwardly between the two folding rollers 3 and 4. The fold per se occurs in the middle of the item and is produced by two resiliently engaged folding rollers 3 and 4. Adjustment of the folding rollers is known and is not therefore shown in FIG. 1. After the two folding rollers 3 and 4 have seized the item i.e. the sheet, the further transport thereof is effected by the pressing action of the outer cylindrical surfaces of the two driven folding rollers 3 and 4.

The folding roller 3 is associated with a cutting roller 5 carrying two cutting knives 6. The two cutting knives 6 cooperate with two or more cutting grooves 7 formed in the outer cylindrical surface of the folding roller 3. The outer cylindrical surfaces of both of the folding rollers 3 and 4 are formed with recesses 8 in which conveyor belts 19 are guided. Both runs or strands 11 of the conveyor belts 9 and 10, respectively, which travel between the folding rollers 3 and 4 come to lie against one another and are guided around the cutting roller 5 so that the folded item which is to be cut is guided accurately and exactly between the folding roller 3 and the cutting roller 5. After a cutting or severing operation, the two conveyor belts 9 and 10 convey the severed folded item into a so-called paddle wheel 12. The folded items 13 are deposited by the latter on an otherwise non-illustrated conveyor belt line and conducted out of or away from the printing machine. Trimmed strips remaining after the cutting operation are removed by suction in a conventional manner.

Both conveyor belts 9 and 10 are guided over belt diverting or deflecting rollers 14 and 15 which are located after or downstream from the cutting roller 5. The cutting roller 5 as well as the two belt diverting rollers 14 and 15 are mounted at both sides thereof in a respective bearing plate or bracket 16, only one of which is shown in FIG. 1, so that the position of the cutting roller 5 is adjustable with respect to the folding roller 3. Both of the bearing plates 16 are pivotally mounted on respective side frames 17 of the second longitudinal folding device via trunnions 18.

The folding roller 3 with the cutting grooves 7 is more clearly illustrated in FIG. 2, each of the cutting grooves 7 being definable in a conventional manner by a cutting or severing ring 19 formed of wear-resistant material. Additionally shown in FIG. 2 are the recesses 8 for the conveyor belts 9. The cutting roller 5 cooperating with the folding roller 3 has two cutting knives 6, as aforementioned, which are mounted on a shaft 22 and are adjustable with respect to a cutting edge 20 by means of nuts 21. Moreover, belt rollers 23 are provided for the two superimposed or mutually adjacent strands or runs 11 of the conveyor belts 9 and 10. When items i.e. sheets of different format size, are processed, the cutting knives 6 are associated with the corresponding cutting grooves 7, for which purpose a suitable number of the cutting grooves 7 are provided. To axially displace or adjust the cutting knives 6 and the cutting grooves 7, the two rollers 3 and 5 may be mounted in such a manner as to permit such a displacement or adjustment. In like manner, the cutting elements can be conventionally mounted on the shafts of the two rollers 3 and 5 so as to be displaceable or adjustable.

The foregoing is a description corresponding, in substance, to German application No. G 85 24 991.2, dated Aug. 31, 1985, International priority of which is being claimed for the instant application, and which is hereby made part of this application. Any material discrepancies between the foregoing specification and the specification of the aforementioned corresponding German application are to be resolved in favor of the latter.

There is claimed:

1. Cutting device in folding apparatus of a rotary printing machine for forming a second longitudinal fold in foldable items, the folding apparatus having a folding blade disposed parallel to a travel direction of the foldable items and disposed in the middle of the items and between two folding rollers located below the folding blade, and a paddle wheel disposed downstream of the folding blade in the travel direction for receiving and depositing the folded items on a delivery belt, the cutting device comprising means defining cutting grooves formed in an outer cylindrical surface of one of the folding rollers, a cutting roller associated with and disposed adjacent to the one folding roller and carrying cutting knives adjustable in position with respect to said cutting grooves, both of the folding rollers being formed on the outer cylindrical surfaces thereof with recesses wherein respective conveyor belts are received, said conveyor belts having respective strands superimposed on one another, said superimposed strands guiding said conveyor belts around said cutting roller and being disposed so as to feed the folded items to the paddle wheel.

2. Cutting device according to claim 1 including two belt diverting rollers located downstream from said cutting roller in the travel direction of the foldable items.

3. Cutting device in folding apparatus of a rotary printing machine for forming a second longitudinal fold in foldable items, the folding apparatus having a folding blade disposed parallel to a travel direction of the foldable items and disposed in the middle of the items and between two folding rollers, located below the folding blade, and a paddle wheel disposed downstream of the folding blade in the travel direction for receiving and depositing the folded items on a delivery belt, the cutting device comprising means defining cutting grooves formed in an outer cylindrical surface of one of the folding rollers, a cutting roller associated with and disposed adjacent to the one folding roller and carrying cutting knives adjustable in position with respect to said cutting grooves, and two belt diverting rollers located downstream from said cutting roller in the travel direction of the foldable items, said cutting roller and said belt diverting rollers being mounted at both sides thereof in bearing plates, said bearing plates being mounted so as to be pivotable about trunnions which are mounted in side frames of the cutting device.

4. Cutting device according to claim 1 wherein said cutting knives are mounted on said cutting roller, and said means defining said cutting grooves are disposed on the one folding roller so as to be axially displaceable and adjustable.

5. Cutting device according to claim 1 wherein the one folding roller is formed with a plurality of said cutting grooves so as to correspond to formats of the foldable items being processed.

* * * * *